United States Patent [19]

Minor

[11] Patent Number: 4,618,249

[45] Date of Patent: Oct. 21, 1986

[54] CORONA-CHARGING APPARATUS

[75] Inventor: James C. Minor, Rochester, N.Y.

[73] Assignee: Eastman Kodak Company, Rochester, N.Y.

[21] Appl. No.: 742,828

[22] Filed: Jun. 10, 1985

[51] Int. Cl.[4] ..... G03G 15/02

[52] U.S. Cl. ..... 355/14 CH; 355/3 CH; 361/229

[58] Field of Search ..... 355/14 CH, 14 R, 3 CH; 361/229, 235; 250/324, 325, 326

[56] References Cited

U.S. PATENT DOCUMENTS

| | | | |
|---|---|---|---|
| 3,678,350 | 7/1972 | Matsumoto et al. | 361/229 |
| 4,096,543 | 6/1978 | Kozuka et al. | 361/235 X |
| 4,312,589 | 1/1982 | Brannan et al. | 355/14 CH |

*Primary Examiner*—Arthur T. Grimley
*Assistant Examiner*—J. Pendegrass
*Attorney, Agent, or Firm*—Milton S. Sales

[57] ABSTRACT

A corona-charging apparatus includes a conductive control grid, at least one corona-emitting electrode, and means for providing a current supply to the electrode. Current is sinked from the grid through a variable resistance, and means are provided for sensing the voltage produced on the insulating surface to be charged.

The electrode power supply is AC, and the grid current sink includes a rectifier circuit. Means, responsive to the sensed voltage adjust the conductivity of the variable resistance in accordance with a predetermined program to thereby maintain the charge on the surface substantially constant.

4 Claims, 4 Drawing Figures

CORONA-CHARGING APPARATUS

BACKGROUND OF THE INVENTION

1. Field of the Invention

This invention relates to apparatus for placing a uniform, predetermined charge onto a member having an insulating layer.

2. Description of the Prior Art

Although the corona-charging apparatus of the present invention has general applications, one preferred application is in the field of electrophotographic apparatus (herein called copiers). In copier corona-charging apparatus, a generally uniform electrostatic charge is deposited on a segment of an imaging member having a photoconductive insulating layer. The charged segment is then advanced to an exposure station where it is exposed to image-forming radiation to form a latent electrostatic image of a document to be copied. The latent image is thereafter developed and subsequently transferred to paper upon which the copied image is to appear.

Consistent, high quality reproduction can best be obtained when a uniform level of charge is applied to the imaging member by the corona-charging apparatus. The contrast value of the electrostatic latent image is related directly to the level of charge on the imaging member before exposure. If the photoconductor is not uniformly charged over the entire area, the contrast value of the latent image obtained upon exposure will vary in different areas of the imaging member, and a mottled effect will be visible on the image when developed.

The current from a corona-emitting electrode is a function of the electrode diameter and the potential applied thereto. Variations in the potential will cause relatively large changes in corona current with corresponding variations in the charging rate. The corona current is also affected by deposits of dust that may accumulate on the electrode and by variations of movement and ionized conditions of the air surrounding the electrode. Thus, minute differences in electrode diameter, slight accumulations of dust on the electrode, and variations in air current or in air pressure drastically affect the corona generating potential of the electrode, causing non-uniform electrostatic charging of the imaging member.

Conventional corona-charging apparatus employ an AC power supply coupled to the corona-emitting electrode through a series of rectifiers to obtain a high DC potential at the electrode. The need for high voltage components to rectify the AC supply current and to properly handle the total current demands of the system greatly add to the expense of the apparatus.

The need for rectification of an AC supply current applied to the corona-emitting electrode has been eliminated in known charging apparatus by locating a control electrode (known as a grid), to which has been applied a potential approximately equal to that to which the photoconductor is to be charged, between the corona-emitting electrode and the imaging member. A DC voltage is impressed upon the grid to regulate the flow of ions from the AC supplied corona-emitting electrode to the imaging member. Although this system produces a uniform charge without the need for rectifying the AC supply current, the system does so at the expense of more components, including a DC power supply for the grid.

In certain known corona-charging apparatus, such as disclosed in commonly-assigned U.S. Pat. No. 3,370,212 which issued on Feb. 20, 1968 to L. F. Frank, the need for a DC power supply for the grid has been eliminated by connecting the grid to reference potential through a rectifier and resistor. Even though there is no active power supply for the grid, there is a control voltage imposed at the grid, which voltage results from the current passing through the resistor.

While the level of charge placed on the imaging member by the Frank apparatus can be regulated to some extent by, for example, the relative movement of the corona-emitting electrode and the imaging member, such control methods are imprecise and involve complicated drive mechanisms. I have intended corona-charging apparatus for applying a potential to the insulating layer of an imaging member using only passive grid control elements in the grid circuit, wherein the applied potential is easily regulated and is extremely uniform.

SUMMARY OF THE INVENTION

It is therefore an object of the present invention to provide a corona-charging apparatus for charging an insulating layer, wherein a grid acts to stabilize the corona current without the need of an active power supply to the grid and wherein the grid current is controlled in response to the sensed charge placed on the insulating layer. Such apparatus, when compared to corona-charging apparatus known in the prior art, is inexpensive, noncomplex, reliable, and compact.

The foregoing, as well as other objects and advantages, are accomplished by providing a corona-charging apparatus including a conductive control grid, at least one corona-emitting electrode, and means for providing a current supply to the electrode. Current is sinked from the grid through a variable impedance, and means are provided for sensing the voltage produced on the insulating surface to be charged.

In a preferred embodiment of the present invention, the electrode power supply is AC, and the grid current sink includes a rectifier circuit. Means, responsive to the sensed voltage adjust the conductivity of the variable impedance in accordance with a predetermined program to thereby maintain the charge on the surface substantially constant.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

The corona-charging apparatus of the present invention has general applications, but will be described herein in a form particularly useful in electrophotographic apparatus (i.e., copiers). Because such apparatus is well known, the present description will be directed in particular to elements forming part of or cooperating more directly with the present invention.

Figure 1:
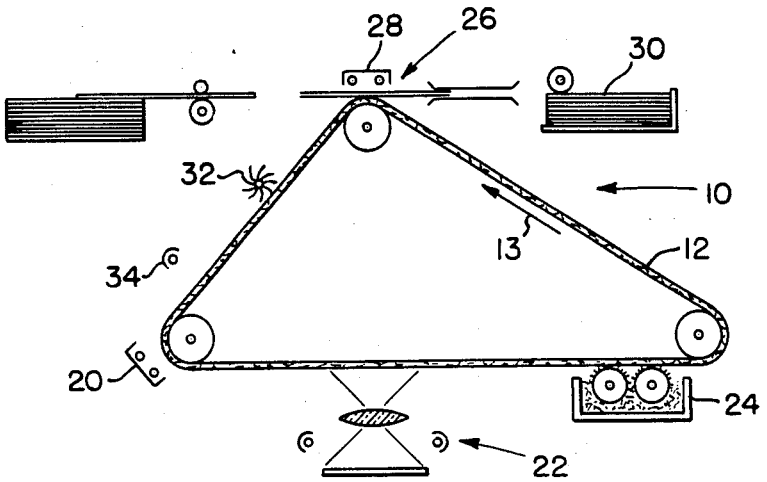
FIG. 1 is a side elevational view in schematic form of a portion of electrophotographic apparatus in accordance with the invention.

With reference to FIG. 1, a web-type copier 10 includes an imaging member 12 mounted for movement in the direction of arrow 13 about an endless path, past various operative stations. As can be seen more clearly in FIG. 2, imaging member 12 includes a photoconductive insulating layer 14 (e.g., of the type disclosed in U.S. Pat. No. 3,615,414) overlying a thin, electrically-conductive layer 16 both supported on a film 18. The conductive layer is electrically connected to ground or other reference potential source by edge contact with rollers of the apparatus or by other techniques known in the art.

Operative stations of copier 10 include a charging station at which corona-charging apparatus 20 applies an overall primary charge to the external surface of photoconductive insulating layer 14. After receiving the primary charge, an image segment of imaging member 12 advances past an exposure station 22 where the segment is imagewise exposed to image-forming radiation. The resultant latent electrostatic image then residing on the segment is next advanced over a magnetic brush development station 24 where toner is attracted to the charge pattern corresponding to dark image areas of the document. The developed image is than advanced to a transfer station 26 where the toner image is transferred by corona discharge device 28 to paper, fed from supply 30.

The image segment from which the toner is transferred advances past a cleaning station 32 in preparation for another copy cycle. Erase illumination source 34 can be located after the cleaning station to dissipate residual charge prior to initiating another copy-making sequence of the image segment.

Figure 2:
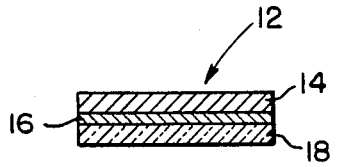
FIG. 2 is an enlarged cross-section of an imaging member for the apparatus shown in FIG. 1.
Figure 3:
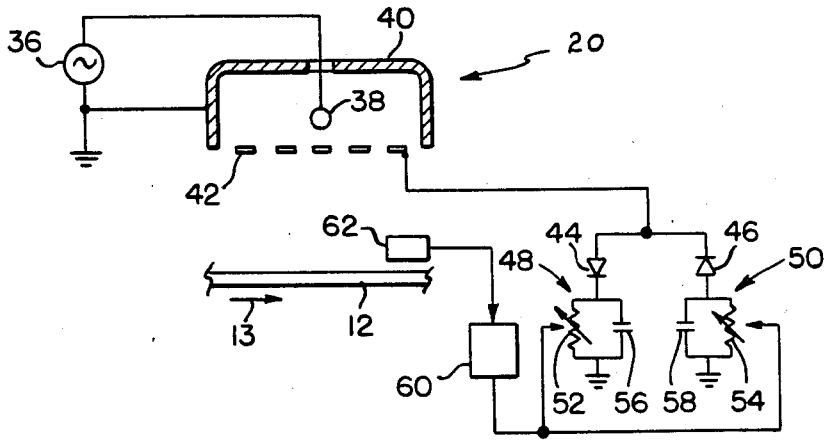
FIG. 3 is a schematic of a portion of the apparatus shown in FIG. 1 that is directed to the depositing of a generally uniform charge upon an imaging member.

FIG. 3 illustrates details of a preferred embodiment of corona-charging apparatus of FIG. 1. A high voltage AC power supply 36 is connected to a corona-emitting electrode 38. Electrode 38 is enclosed in a grounded shield 40. Below shield 40 is a segment of an imaging member 12, such as illustrated in FIG. 2, which is to be charged.

A conductive grid 42 is positioned between corona-emitting electrode 38 and photoconductor 12. The grid is connected to ground through a pair of diodes 44 and 46 and their respective RC circuits 48 and 50. Each RC circuit includes a variable impedance such as adjustable resistors 52 and 54, and a capacitor 56 and 58. The capacitors are used for smoothing and stability, and may be considered to be optional.

OPERATION OF THE PREFERRED EMBODIMENT

Assuming that a positive charge is to be placed on imaging member 12, resistor 54 is adjusted to a small value; effectively a short circuit. During the positive half cycle of AC power supply, current flows from corona-emitting electrode both to grid 42 and to imaging member 12; the division of current being a function of the relative voltages of the grid and the imaging member. Grid current flows through diode 44 and adjustable resistor 48. Accordingly, the grid voltage and the aforementioned division of current are direct functions of the resistivity of the adjustable resistor.

During the negative half cycle of AC power supply, diode 46 maintains grid 42 at reference or ground potential, resistor 54 being shorted. As such, there is no charge flow to imaging member 12. If desired, resistor 50 could be adjusted to cause a slight charge flow to the imaging member. For placing a negative charge on the imaging member, the relative values of resistors 52 and 54 can be reversed.

The value of adjustable resistors 52 and 54 are regulated by a controller 60 and an electrometer 62. The electrometer is conventional and may include a scanning probe which is translated across imaging member 12 in a transverse direction for averaging purposes.

Figure 4:
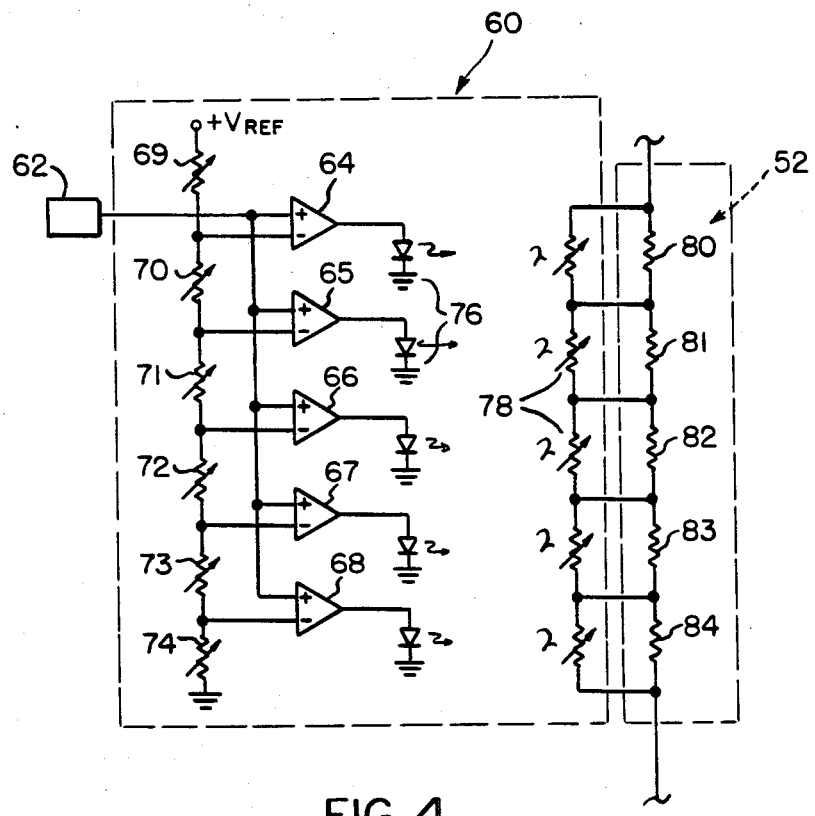
FIG. 4 is a schematic diagram of a controller for use with the apparatus of FIG. 1.

Controller 60 is responsive to the output of electrometer 12 to regulate the values of the resistors. FIG. 4 illustrates one embodiment of a controller, suitable for effecting a desired adjustment to resistors 52 and 54, although other controllers will readily occur to those skilled in the art.

A set of parallel differential comparators 64–68 compare reference voltages at the inverting input with the output of electrometer 62. When the electrometer voltage exceeds the reference voltage for a given comparator, a "high" signal is generated at the output of the comparator. The reference voltage for each comparator is set by a voltage divider network including variable resistors 69–75. Each differential comparator is associated with a respective light emitting diode (LED) 76 which is activated when the comparator generates a "high" signal. In turn, each LED causes one photoconductor cell 78 to conduct when the associated LED is active. A conducting photoconductive cell shorts out a portion 80–84 of variable resistor 52, removing that portion of the resistor from the total, and decreasing the value of resistor 52.

When only a small voltage is sensed on imaging member 12, none or only a few differential comparators are "high" starting from the bottom comparator in FIG. 4. Thus, all or most of photoconductive cells 78 are non-conductive to maximize the value of resistor 52 and thereby increase the voltage at grid 42. As the imaging member voltage increases, more LED's 76 are activated until a desired voltage is reached.

Resistor portions 80–84 may be equal to each other, or for non-linear control, may be of different values to optimize control about a presumed optimum value. Controller 60 has been rendered adjustable by allowing for adjustment of variable resistors 69–74. Thus, the imaging member voltage at which each individual comparator 64–68 goes "high" can be fine tuned to accommodate various machine parameters.

The present invention includes a feedback control of the grid voltage using measurements of potential on the imaging member, and it is highly desirable that that control be adjustable. However, the controller illustrated and described herein is exemplary, and programmable controller designs will readily occur to those skilled in the art.

For example, signals from the electrometer relating to imaging member potential may be digitized and fed to a computer which can calculate or provide through a look-up table in memory a desired grid potential. The output from the computer can illuminate the respective LED's 76 or render conductive suitable gate-actuatable rectifiers comprising the equivalent of photoconductors 78.

The invention has been described in detail with particular reference to certain preferred embodiments thereof, but it will be understood that variations and modifications can be effected within the spirit and scope of the invention.

I claim:

1. In a corona-charging apparatus for charging an insulating layer wherein the apparatus includes a conductive control grid, at least one corona-emitting electrode, and a power supply to the electrode, the improvement comprising:

a variable impedance;

circuit means, without an active power supply to the grid, for sinking current from the grid through said variable impedance;

means for sensing the charge in the insulating layer; and control means responsive to said sensing means for adjusting the value of said variable impedance to maintain said charge at a predetermined level.

2. In the corona-charging apparatus defined in claim 1, the improvement wherein said variable impedance consists of a variable resistance.

3. In the corona-charging apparatus defined in claim 1, the improvement further comprising a rectifying circuit within said sinking circuit means, and wherein said electrode power supply is AC.

4. in the corona-charging apparatus defined in claim 1, the improvement further comprising adjustment means in said control means for varying the response of said control means to said sensing means.

* * * * *